US009175895B2

(12) United States Patent
Stock

(10) Patent No.: US 9,175,895 B2
(45) Date of Patent: Nov. 3, 2015

(54) DEVICE FOR MAKING ICE PIECES

(71) Applicant: Miele & Cie. KG, Guetersloh (DE)

(72) Inventor: Andreas Stock, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 309 days.

(21) Appl. No.: 13/786,549

(22) Filed: Mar. 6, 2013

(65) Prior Publication Data

US 2013/0233007 A1 Sep. 12, 2013

(30) Foreign Application Priority Data

Mar. 8, 2012 (EP) ..... 12 401 039

(51) Int. Cl.
*F25C 5/18* (2006.01)
*F25C 5/00* (2006.01)

(52) U.S. Cl.
CPC ..... *F25C 5/007* (2013.01); *F25C 5/187* (2013.01); *F25C 2700/02* (2013.01)

(58) Field of Classification Search
CPC ..... F25C 5/187; F25C 2700/02
USPC ..... 62/137
See application file for complete search history.

(56) References Cited

U.S. PATENT DOCUMENTS

| | | | | |
|---|---|---|---|---|
| 3,816,745 | A * | 6/1974 | Primm et al. | 250/221 |
| 4,662,182 | A | 5/1987 | Tsukiyama et al. | |
| 6,414,301 | B1 * | 7/2002 | Borg et al. | 250/222.1 |
| 8,424,323 | B2 * | 4/2013 | Austin et al. | 62/137 |
| 2008/0157644 | A1 | 7/2008 | Lee et al. | |
| 2009/0193824 | A1 * | 8/2009 | Heger et al. | 62/126 |
| 2009/0211292 | A1 * | 8/2009 | Smith et al. | 62/344 |
| 2009/0249814 | A1 | 10/2009 | Hausmann et al. | |

FOREIGN PATENT DOCUMENTS

| | | |
|---|---|---|
| DE | 40 20 128 C2 | 5/2001 |
| DE | 10 2005 057 139 A1 | 6/2007 |

OTHER PUBLICATIONS

WO 2012 074323 (English Abstract).*

* cited by examiner

*Primary Examiner* — Jonathan Bradford
(74) *Attorney, Agent, or Firm* — Leydig, Voit & Mayer, Ltd.

(57) ABSTRACT

A device for making ice pieces includes an ice piece producing unit, a collection container for receiving ice pieces produced in the ice piece producing unit and a detection device for monitoring a fill level of the collection container. The detection device includes a signal-emitting device and a signal receiving device, where the signal-emitting device is adjustable. Alternatively, the detection device includes a signal-emitting device, a reflector and a signal receiving device, where the reflector is adjustable.

17 Claims, 3 Drawing Sheets

DEVICE FOR MAKING ICE PIECES

CROSS REFERENCE TO RELATED APPLICATIONS

This application claims priority to European Patent Application No. EP 12 401 039.8, filed Mar. 8, 2012, which is hereby incorporated by reference herein in its entirety.

FIELD

The present invention relates to a device for making ice pieces.

BACKGROUND

Today, the field of gastronomy is unimaginable without ice pieces made of water for cooling foods and beverages. Because of the quantities needed, devices for making ice pieces have always been used. However, making ice pieces is becoming increasingly important and interesting for private users as well. For this reason, devices for making ice pieces are already known, either as separate devices or integrated into freezers or refrigerators.

The basic design of such a device for making ice pieces is always similar. More particularly, there is always at least one ice piece producing unit and a collection container in which the ice pieces produced are received and from which they can be removed by the user. What differs is the way in which the ice pieces are produced in the ice piece producing unit and the manner in which the fill level in the collection container is monitored.

It is known, for example, to monitor the fill level in the collection container using sensor means, such as mechanical, electronic, electromechanical, or optical sensors. The prior art, however, has the disadvantage and inconvenience that only two conditions are detectable, namely, when the collection container is full and when it is empty and needs to be refilled. However, depending on the user's habits, it may not always be required or desired for the collection container to be completely filled. Moreover, it has been found that the ice pieces become connected and adhere to each other when no ice pieces are removed from the collection container over a prolonged period of time. In that case, the ice pieces are "expired". In addition, they shrink and change their shape because they lose moisture as a result of the cooling process. Furthermore, prolonged storage involves the risk of deterioration in the overall quality of the ice pieces. Another negative aspect of such devices for making ice pieces is that the energy consumption increases disproportionately with the number of excessive ice pieces.

German Patent Publication DE 40 20 128 C2, for example, describes a device for making ice pieces where the ice pieces are formed on cooling fingers which are in communication with a compression cooling unit. The cooling fingers are immersed in a water tray and subsequently cooled to the freezing temperature so that the surrounding water freezes on the cooling fingers. The ice pieces so produced can subsequently be released into a collection container by briefly heating the cooling fingers. In this design, the water tray is pivotable about an axis so that the water remaining therein after making the ice pieces can be poured out. Moreover, a feeler arm is provided as a detection device on the outer edge of the water tray to monitor the fill level of the collection container. When pouring out the residual water, the water tray is pivoted so that the path of movement of the feeler arm is blocked when a predetermined fill level is reached. As a result, an electric controller interrupts the production of ice. As explained earlier herein, this approach has the disadvantage that the fill level of the collection container must always be at the same height, and that ice pieces are produced until the maximum fill level of the collection container is reached.

A similar device for making ice pieces is described in DE 10 2005 057 139 A1. Here, the ice pieces are produced by introducing water into a suitable ice tray which is pivotable about an axis. Once the water is frozen, the ice tray is pivoted about its axis, and the ice pieces are mechanically removed from the ice tray by a finger during the rotational movement. In order to monitor the fill level of the container and to control the ice cube supply as a function of the detected fill level, a detection device in the form of a light barrier is used which defines the upper fill level of the collection container. When the light beam of the light barrier is interrupted, the production of the ice pieces is stopped by a suitable control circuit. As long as the light barrier is not interrupted, the production of ice pieces continues, which involves the above-mentioned disadvantages. Here, too, the ice pieces are therefore not produced according to demand. Consequently, it is not possible to adjust the production of ice pieces in a flexible way.

SUMMARY

In an embodiment, the present invention provides a device for making ice pieces including an ice piece producing unit, a collection container for receiving ice pieces produced in the ice piece producing unit and a detection device for monitoring a fill level of the collection container. The detection device includes a signal-emitting device and a signal-receiving device, where the signal-emitting device is adjustable. Alternatively, the detection device includes a signal-emitting device, a reflector and a signal receiving device, where the reflector is adjustable.

BRIEF DESCRIPTION OF THE DRAWINGS

The present invention will be described below in more detail with reference to the accompanying drawings. The exemplary embodiments shown are merely illustrative of certain principles of the present invention, and should not be construed as limiting it to the variants shown. Identical or similar components are denoted by the same reference numerals. For the sake of illustrating the operating principle of the present invention, the figures are greatly simplified schematic views in which certain components have been omitted. However, this does not mean that such components are not present in an approach in accordance with the present invention.

In the drawings.

DETAILED DESCRIPTION

Figure 1:
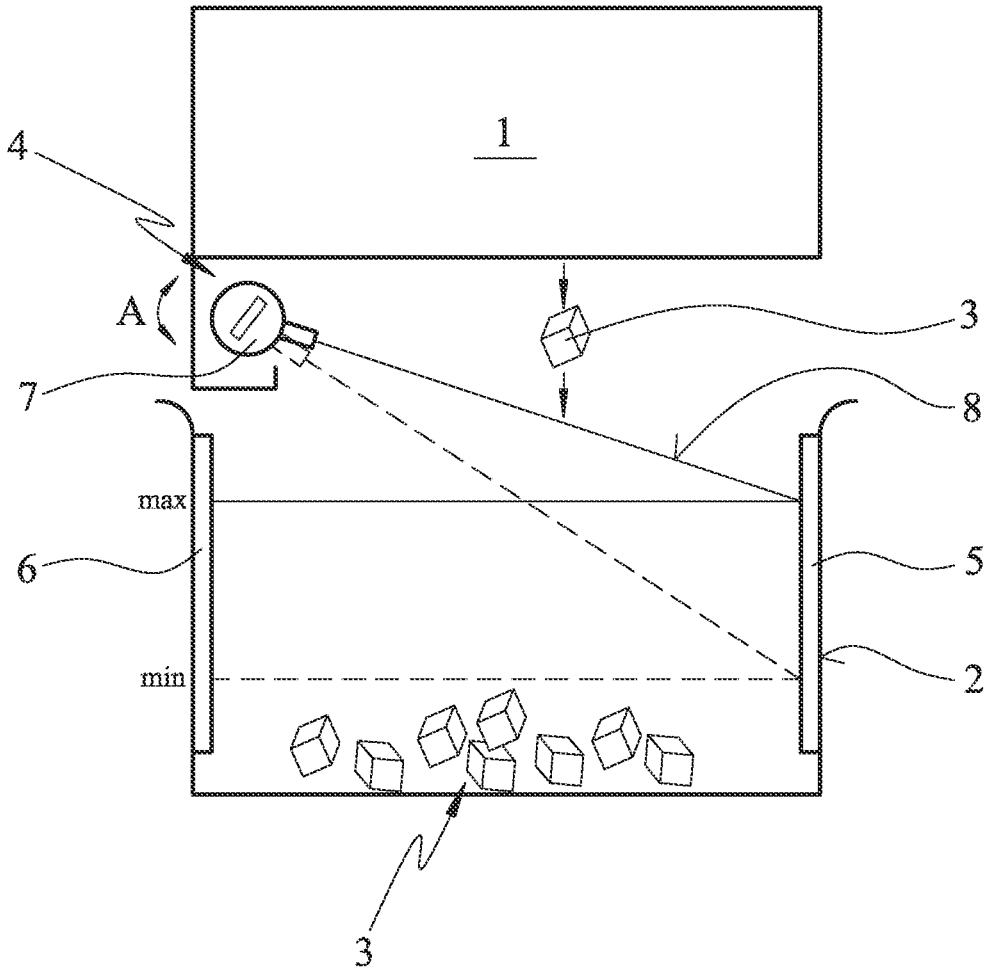
FIG. 1 shows a first design variant of a device for making ice pieces, this variant having a signal-emitting device which is pivotable about an axis.

An aspect of the present invention is to provide a device for making ice pieces which allows the fill level of the container to be set to various levels according to demand.

A device for making ice pieces, including an ice piece producing unit and a collection container for receiving the ice pieces produced in the ice piece producing unit, and further including a detection device for monitoring the fill level of the collection container is improved, according to the present invention, in that the detection device is formed by a signal-emitting device and a signal-receiving device, and in that the signal-emitting device is adjustable.

Another device for making ice pieces, including an ice piece producing unit and a collection container for receiving the ice pieces produced in the ice piece producing unit, and further including a detection device for monitoring the fill level of the collection container is characterized in that the detection device is formed by a signal-emitting device, a reflector and a signal-receiving device, and in that the reflector is adjustable.

One particular advantage of the approaches of the present invention is that the adjustability makes it possible to produce ice pieces according to demand, and to thereby achieve significant energy savings. Moreover, the ice pieces always have a constant quality and do not age anymore. Also, there is no more risk of ice pieces adhering to each other, because the residence time in the collection container is reduced.

The use of a reflector which is adjustable in addition to, or alternatively to, the signal-emitting device overall provides a greater variety of design options, so that a device equipped with such a reflector can be given a compact design and, in addition, the ease-of-use can be optimized.

A first embodiment of the present invention is a device for making ice pieces where the reflector is adjustable in height and/or tilt.

In this way, the maximum allowable fill level of the collection container can be individually adjusted with simple means.

Alternatively or additionally, it is also proposed that the signal-emitting device should be adjustable in height and/or rotatable about an axis.

Thus, this approach not only allows for height adjustment, but also allows for rotation or pivoting of the signal-emitting device. This enables optimal adaptation to the installation conditions. In addition, the range of adjustment for the maximum allowable fill level of the collection container can also be increased in this manner.

The approaches mentioned above have the particular advantage that they can be used independently of the sensor means employed.

It is even conceivable to retrofit existing devices with a suitable adjustment feature.

In another refinement of the present invention, it is proposed that the signal-emitting device or the reflector be adjustable between at least two positions or continuously.

Thus, it is possible, for example, to select a desired fill level for the collection container using a scale provided on the device for making ice pieces. The user can chose between the settings mentioned depending on the particular embodiment, so that the ice pieces can be produced very flexibly according to demand.

In one embodiment of the present invention, in order to simplify the aforementioned adjustment, the signal-emitting device or the reflector is adjustable by means of a lever, a handle, a rotary knob, or an adjusting screw. The selection between these control elements is dependent on the desired level of user convenience or on the installation conditions, and is not limited to the aforementioned examples.

In particular, if an optical signal-emitting device is selected, it may be particularly advantageous if the reflector is plane, concave or convex in shape. In this manner, various fill level settings can be achieved using the laws of optics.

In accordance with an embodiment of the present invention, a frequency generator generating an acoustic wave, an ultrasonic transmitter, an infrared transmitter, or a laser may be used as the signal-emitting device; the reflector and the signal-receiving device being designed correspondingly. Other signal-emitting devices may, of course, also be used. The signal-emitting device could, for example, also be a pneumatic signal-emitting device.

Designing the signal-receiving device and the reflector correspondingly means that both the reflector and the signal-receiving device must be capable of handling the signals produced by the signal-emitting device. Therefore, the individual components must be compatible in order to function optimally.

In one specific embodiment of the present invention, the detection device is designed as a light barrier and the signal-emitting device is a laser. This particularly simple approach is advantageous because such light barriers are available in various designs, which makes it possible to significantly simplify the device for making ice pieces as a whole. Moreover, the advantage of a light barrier lies in its high accuracy.

In accordance with a further proposal of the present invention, the output signal of the detection device is used to control the production of ice pieces as a function of the detected fill level of the collection container. In other words, the production of ice pieces is interrupted when the preset fill level of the collection container is reached. This can be accomplished, for example, by interfering with the water cycle by interrupting the water supply, or by stopping the freezing process.

FIG. 1 shows, rather schematically and in greatly simplified form, the general design of a device for making ice pieces, in which an ice piece producing unit 1 is used for producing the ice pieces 3 needed. The ice pieces 3 produced in ice piece producing unit 1 fall into a collection container 2 provided for this purpose. The fill level of the collection container increases with the number of ice pieces 3 produced. Further, a signal-emitting device 4 is disposed underneath ice piece producing unit 1. In this embodiment, said signal-emitting device emits a laser beam 8. Laser beam 8 hits a reflector 5 within collection container 2. This reflector reflects the light beam and directs it onto a suitable signal-receiving device 6. Signal-receiving device 6 is capable of producing an output signal which is used by a controller to continue or interrupt the production of ice pieces. FIG. 1 shows two different positions of signal-emitting device 4. A solid line defines a maximum fill level of collection container 2 (designated "max"), and a dashed line defines a minimum fill level of collection container 2 (designated "min"). Signal-emitting device 4 can be pivoted about an axis using a rotary knob 7, thereby allowing selection of the different fill levels of collection container 2. The rotational movement of signal-emitting device 4 occurs in the direction of double-headed arrow "A".

It should be noted in connection with this embodiment and the examples that follow that signal-emitting device 4 may, of course, also be disposed on collection container 2. Thus, it does not necessarily have to be disposed underneath ice piece producing unit 1.

Figure 2:
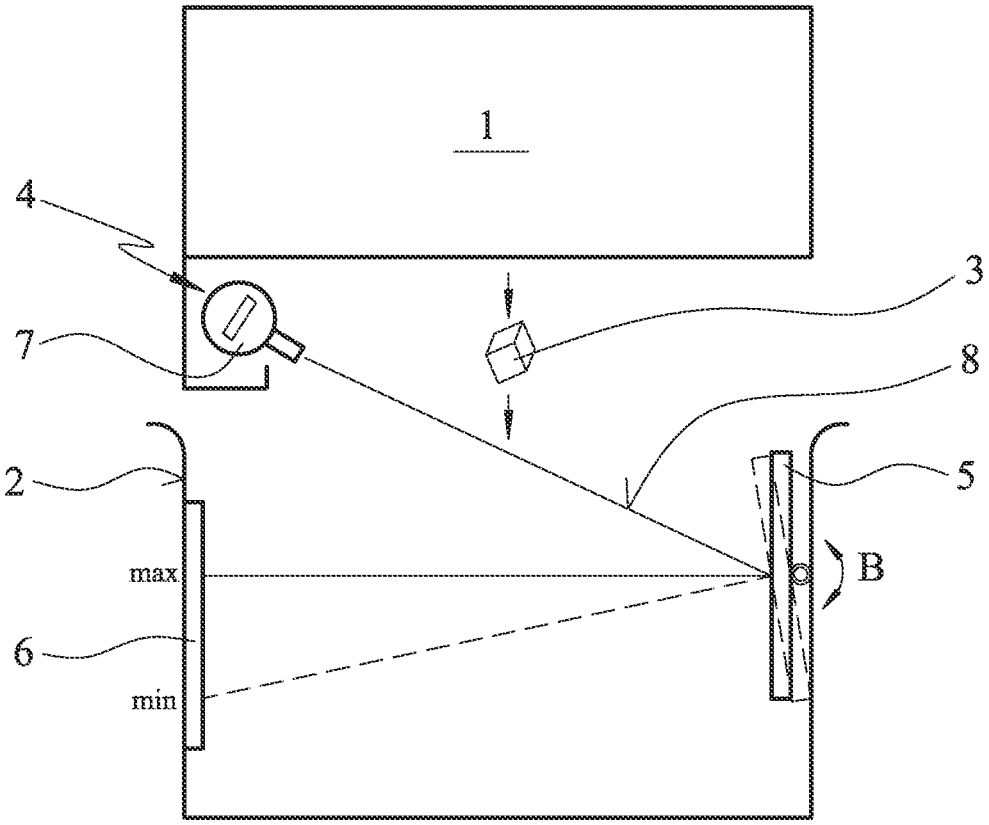
FIG. 2 shows another design variant of a device for making ice pieces, this variant having a pivotable reflector.

FIG. 2 shows a device for making ice pieces which is substantially identical in design to the embodiment described in connection with FIG. 1. The difference here is that signal-emitting device 4 is not pivotable about an axis, but instead reflector 5 is mounted in collection container 2 such that it is pivotable about an axis. The direction of movement of reflector 5 is indicated by double-headed arrow "B" in FIG. 2. Using such an approach, laser beam 8 emitted by signal-emitting device 4 can be reflected in various different directions. As indicated in FIG. 2, at least two fill levels, "min" and "max", can be selected. In the illustrated case of a plane reflector 5, the fill level line may be inclined. In order to avoid this, the reflector may also have an optically curved surface.

Figure 3:
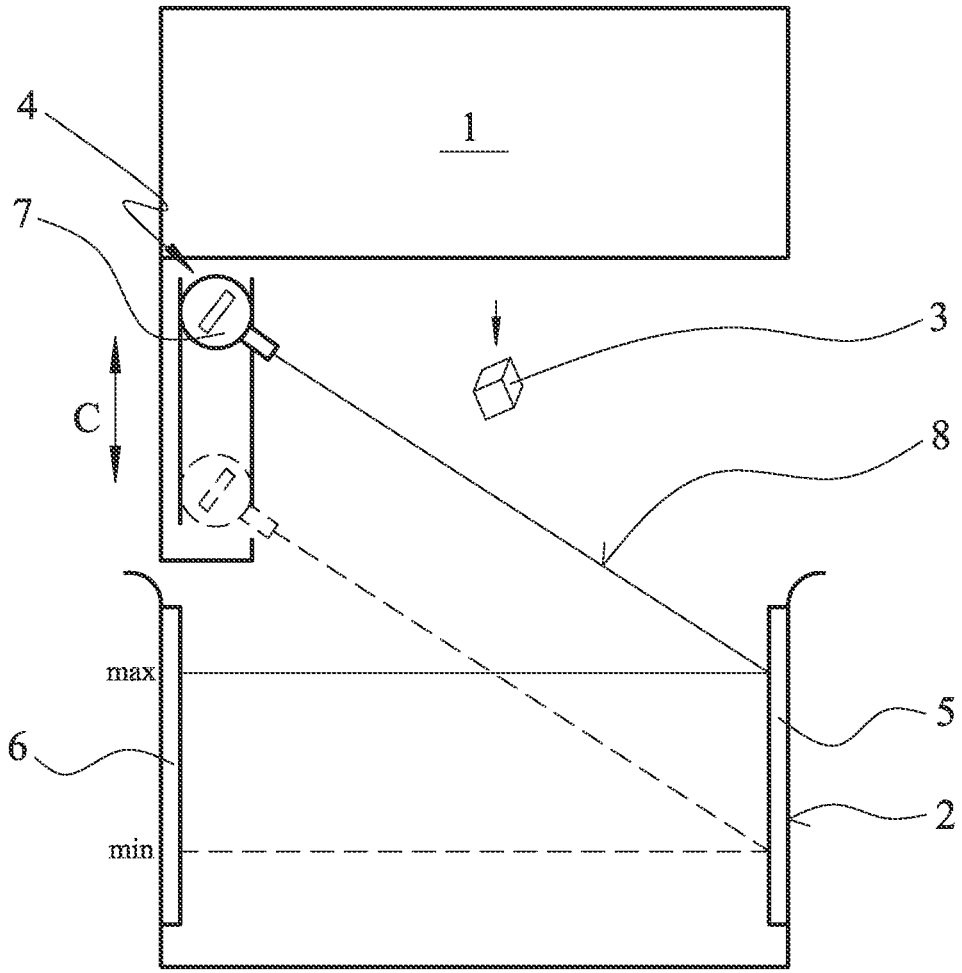
FIG. 3 shows a third design variant of a device for making ice pieces, this variant having a signal-emitting device which is adjustable in height.

FIG. 3 finally shows, by way of example, a third design variant of a device for making ice pieces, the essential components of which are identical to [those of] the two approaches described above. The substantial difference in this device resides in the capability of adjusting the height of signal-emitting device 4. In this regard, FIG. 3 fragmentarily shows a guide of signal-emitting device 4 within which the signal-emitting device can be displaced in the direction of double-headed arrow "C". Here, at least two different fill levels of collection container 2 can be detected. Again, a maximum fill level is indicated by the solid line representing laser beam 8, and the minimum fill level is indicated by the dashed line of laser beam 8. In FIG. 3, these fill levels are designated "min" and "max". In this approach, signal-emitting device 4 is only displaceable within its guide, but not pivotable about an axis; although of course such a combination is not excluded from the scope of the present invention.

LIST OF REFERENCE NUMERALS

1 ice piece producing unit
2 collection container
3 ice pieces
4 signal-emitting device
5 reflector
6 signal-receiving device
7 rotary knob
8 laser beam

What is claimed is:

1. A device for making ice pieces comprising:
an ice piece producing unit;
a collection container for receiving ice pieces produced in the ice piece producing unit; and
a detection device for monitoring a fill level of the collection container, the detection device including a signal-emitting device and a signal-receiving device, the signal-emitting device being pivotably disposed outside the collection container at a pivot axis so that a pivoting of the signal-emitting device about the pivot axis provides an adjustment of the fill level of the collection container between a minimum fill level and a maximum fill level.

2. The device for making ice pieces recited in claim 1, wherein the signal-emitting device is pivotable between at least two positions.

3. The device for making ice pieces recited in claim 1, wherein the signal-emitting device is continuously pivotable.

4. The device for making ice pieces recited in claim 1, wherein the signal-emitting device is pivotable using at least one of a lever, a handle, a rotary knob, or an adjusting screw.

5. The device for making ice pieces recited in claim 1, further comprising a reflector, wherein the reflector is plane, concave or convex in shape.

6. The device for making ice pieces recited in claim 1, wherein the signal-emitting device includes at least one of a pneumatically acting signal-emitting device, a frequency generator configured to generate an acoustic wave, an ultrasonic transmitter, an infrared transmitter or a laser, and wherein the signal-receiving device is designed to correspond to the signal-emitting device.

7. The device for making ice pieces recited in claim 1, wherein the detection device includes a light barrier and the signal-emitting device includes a laser.

8. The device for making ice pieces recited in claim 1, wherein an output signal of the detection device is operable to control production of the ice pieces as a function of a detected fill level of the collection container.

9. A device for making ice pieces comprising:
an ice piece producing unit;
a collection container for receiving ice pieces produced in the ice piece producing unit; and
a detection device for monitoring a fill level of the collection container, the detection device including a signal-emitting device pivotably disposed outside the collection container at a pivot axis so that a pivoting of the signal-emitting device about the pivot axis provides an adjustment of the fill level of the collection container between a minimum fill level and a maximum fill level, a reflector and a signal-receiving device, the reflector being adjustable.

10. The device for making ice pieces recited in claim 9, wherein the reflector is adjustable in at least one of height and tilt.

11. The device for making ice pieces recited in claim 9, wherein the reflector is adjustable between at least two positions.

12. The device for making ice pieces recited in claim 9, wherein the reflector is continuously adjustable.

13. The device for making ice pieces recited in claim 9, wherein the reflector is adjustable using at least one of a lever, a handle, a rotary knob, or an adjusting screw.

14. The device for making ice pieces recited in claim 9, wherein the reflector is plane, concave or convex in shape.

15. The device for making ice pieces recited in claim 9, wherein the signal-emitting device includes at least one of a pneumatically acting signal-emitting device, a frequency generator configured to generate an acoustic wave, an ultrasonic transmitter, an infrared transmitter or a laser, and wherein the signal-receiving device is designed to correspond to the signal-emitting device.

16. The device for making ice pieces recited in claim 9, wherein the detection device includes a light barrier and the signal-emitting device includes a laser.

17. The device for making ice pieces recited in claim 9, wherein an output signal of the detection device is operable to control production of the ice pieces as a function of a detected fill level of the collection container.

* * * * *